US005377378A

United States Patent [19]

Cutler

[11] Patent Number: 5,377,378

[45] Date of Patent: Jan. 3, 1995

[54] DRY CLEANING PAD

[76] Inventor: Barry L. Cutler, 7 Stanford Ct., East Windsor, N.J. 08520

[21] Appl. No.: 176,997

[22] Filed: Jan. 3, 1994

[51] Int. Cl.[6] ..... A47L 11/14

[52] U.S. Cl. ..... 15/230; 15/227; 15/230.16; 15/DIG. 5; 15/DIG. 6

[58] Field of Search ..... 15/114, 208, 209.1, 15/227, 230, 230.16, DIG. 5, DIG. 6

[56] References Cited

U.S. PATENT DOCUMENTS

| | | | |
|---|---|---|---|
| 4,244,074 | 1/1981 | Barcikowski et al. | 15/114 |
| 4,295,622 | 10/1981 | Cutler | 248/313 |
| 4,418,438 | 12/1983 | Cutler | 15/230 |
| 4,961,243 | 10/1990 | Barber | 15/230 |
| 4,980,943 | 1/1991 | Barber | 15/227 |
| 4,998,314 | 3/1991 | Bofofsky | 15/230.16 |
| 5,142,727 | 9/1992 | Koester | 15/230 |

FOREIGN PATENT DOCUMENTS

| | | | |
|---|---|---|---|
| 2726485 | 12/1978 | Germany | 15/209.1 |

*Primary Examiner*—Mark Spisich

[57] ABSTRACT

A cleaning pad for use for cleaning carpet, rugs, furniture and like includes a pair of circular base sheets of a non-woven materials secured together at their peripheries. In each base sheet are at least first and second strips of piles of a fibrous bristle with the fibrous bristles of the first strips being stiffer than the fibrous bristles of the second strip. The fibrous bristles of the first strips have a shorter pile height than the pile height of the fibrous bristles of the second strips. A bed of firmly looped strands woven to a hooked rug solidity to present a cleaning surface fill in the space of each base sheet between the strips. For a carpet cleaning pad, there are preferably two of the first strips and two of the second strips on each base sheet. Each of the first strip forms a V with a separate one of the second strips with the apices of the V's being adjacent the periphery of the base sheet and being diagonally opposite each other. The V's on one of the base sheets are spaced circumferentially 90° from the V's on the other base sheet.

17 Claims, 2 Drawing Sheets

DRY CLEANING PAD

FIELD OF THE INVENTION

The present invention relates to a dry cleaning pad, and, more particularly, to a pad for use in dry cleaning carpet, rugs, furniture and the like.

BACKGROUND OF THE INVENTION

Two techniques typically used to clean floor carpet, rugs, furniture and the like are wet cleaning, such as hot water extraction or so-called "steam cleaning" and shampooing, and dry cleaning. For dry cleaning carpets, a cleaning fluid is sprayed onto the carpet and a pad is rotated over the carpet to work the cleaning solution into the carpet and thereby remove the dirt, and to absorb the dirty cleaning solution from the carpet. One type of machine which can be used for dry cleaning carpets is shown in U.S. Pat. No. 4,295,622, to B. L. Cutler, issued Oct. 20, 1981, entitled FRAMEWORK HOLDER FOR ATTACHING CONTAINER TO FLOOR MACHINE. The machine shown in this patent includes a housing having a flat, circular brush across its open bottom and containing a motor for rotating the brush. A container is mounted on the housing and contains the cleaning solution which is adapted to be sprayed onto the carpet. An elongated handle is attached to the housing to permit the brush to be moved across the carpet. A cleaning pad is mounted under the brush is adapted to be rotated and moved along the carpet with the brush.

Initially, the cleaning pads used with such a dry cleaning machine were more or less of a mop-like or shag-like consistency in that the surface which bears on the carpet is soft and yielding. This type of pad has a shaggy surface and not a firm surface. It has the disadvantage that it lacks the aggressive stripping and scrubbing fibers which are necessary to perform an effective cleaning action.

Pads were then made with firm surfaces to bear on the surface to be cleaned and were made by tightly looping strands of string synthetic material through a base sheet. Such a pad is more like a hooked rug in that its working surface is quite firm. These pads have the advantage of actively cleaning the carpet and picking up in the pad a considerable amount of the dirt which is lodged deep in the carpet or rug.

To further improve the scrubbing action of the pad, strips of fibers which are much like the consistency of conventional hairbrushes were incorporated into the pad. Such a pad is shown in U.S. Pat. No. 4,418,438, to B. L. Cutler, issued Dec. 6, 1983, entitled ROTARY CARPET CLEANING PAD. The pad of this patent has strips of fiber bristles arranged radially along a circular base sheet and in an annular strip around the periphery of the base sheet. The remaining portion of the base sheet is filled with firm loops of strand material to form a bed of hooked rug solidity. The strips of bristles provide good scrubbing action and the remainder of the pad provides for good absorption of the dirty cleaning liquid to remove the dirt from the carpet. However, it is always desirable to have a cleaning pad which provides for better and faster cleaning action of the carpet. Although it is desirable to have a pad with good and deep scrubbing action, care must be taken that such scrubbing action does not damage the carpet.

SUMMARY OF THE INVENTION

The present invention is directed to a cleaning pad which comprises a base sheet of a non-woven material having first and second strips of fibrous bristles in said base sheet. The fibers of the first strip are stiffer than the fibers of the second strip. A bed of firmly looped strands woven to a hooked rug solidity fill in the space of the base sheet between the strips.

DETAILED DESCRIPTION

Figure 1:
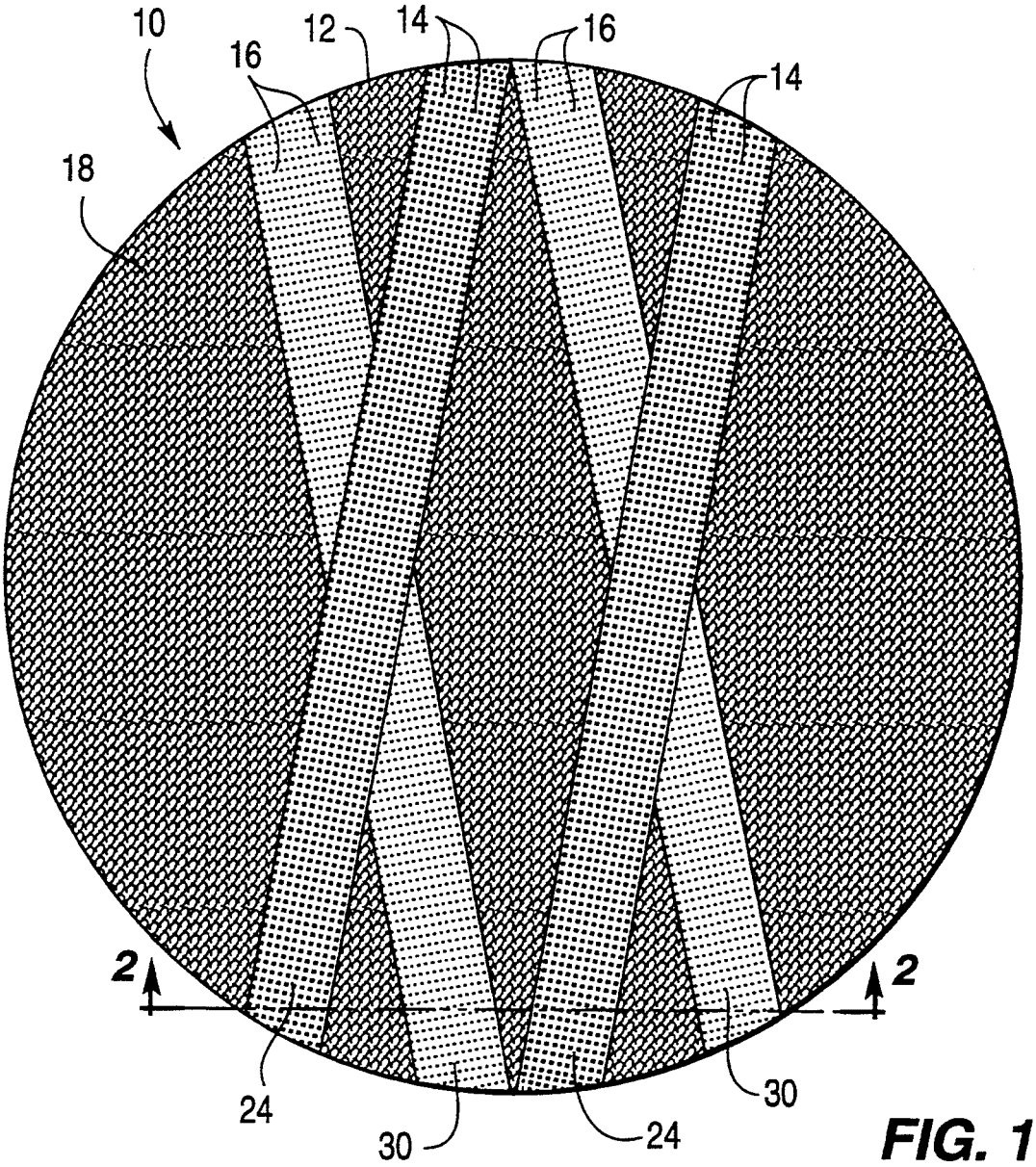
FIG. 1 is a top plan view of a form of the cleaning pad of the present invention.
Figure 2:
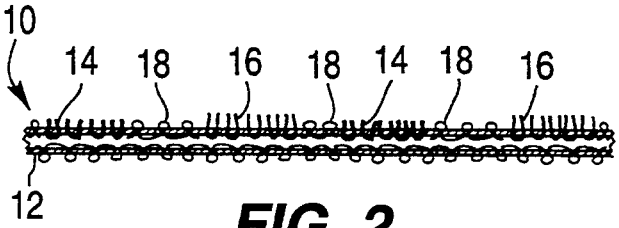
FIG. 2 is a sectional view taken along line 2—2 of FIG. 1.

Referring to FIGS. 1 and 2, there is shown one form of the cleaning pad 10 of the present invention. The pad 10 is circular in shape and includes a pair of circular base sheets 12 of a strong non-woven material. The base sheets 12 are of a strong burlap type synthetic material, such as non-woven polypropylene. The base sheets 12 are secured together at their peripheries, such as by being stitched together. Each of the base sheets 12 has thereon three sets of different types of piles 14, 16 and 18. The first set of piles 14 is made up of bristles or relatively stiff fibers which are more or less like those in a hair brush, such as bristles of nylon. The second set of piles 16 is also made up of bristles or relatively stiff fibers but not as stiff as those of the first set of piles 14. The second set of piles may be made of fibers of olefin. Thus, the bristles of the first set of piles 14 are stiffer than the bristles of the second set of piles 16. The third set of piles 18 are of strands of strong, tough synthetic materials which will withstand the wear and tear of rubbing on the surface to be cleaned but are absorbent.

Figure 3:
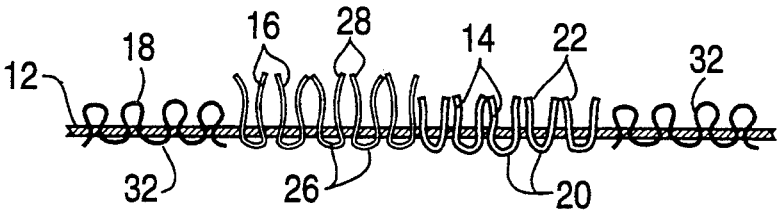
FIG. 3 is an enlarged sectional view of a portion of the cleaning pad.

As shown in FIG. 3, the bristles of the first set of piles 14 are formed U-shaped pieces of the stiff fibers tufted through the base sheet 12 so that the bases 20 of the U-shaped pieces are all on the inner side of the base sheets 12 and the free ends 22 are all on the outer sides of the base sheets 12. The first set of piles 14 are arranged in a pair of spaced, parallel rows to form elongated strips 24 of the piles 14 which extend across the base sheets 12. Each of the strips 24 is formed of a plurality of rows of the piles 14. The bristles of the second set of piles 16 are also formed U-shaped pieces of the less stiffer fibers tufted through the base sheet 12 so that the bases 26 of the U-shaped pieces are all on the inner side of the base sheets 12 and the free ends 28 are all on the outer sides of the base sheets 12. As can be seen in FIG. 3, the fibers of the first set of piles 14 have a shorter pile height than the fibers of the second set of piles 16. The second set of piles 16 are also arranged in a pair of spaced, parallel rows to form elongated strips 30 of the piles 16 which extend across the base sheets 12. Each of the strips 30 is formed of a plurality of rows of the second set of piles 16. Each of the strips 24 of the first set of piles 14 forms a V with a separate one of the strips 30 of the second set of piles 16. Since there are two strips 24 and two strips 30, they form two V's. The apex of each of the V's is at the periphery of the base sheet 12 and the two apices are diagonally opposite each other for symmetry and balance. Also, the apices of the V's on one of the base sheets 12 are arranged 90° from the apices of the V's of the other base sheet 12 to achieve complete balance of the cleaning pad 10.

The third set of piles 18 are of the hooked rug type as it is made of flexible strands which are repeatedly hooked into the base sheet 12 as shown in FIG. 3. The third set of piles 18 have loops 32 which are spaced along the outer surface of the base sheet 12. The third set of piles 18 fills the remaining area of the base sheets 12 between the strips 24 and 30. The exposed loops 32 form an extremely dense surface to perform a cleaning action and to retain dirt under the firm surface.

In the use of the cleaning pad 10 for cleaning a carpet, such as with the cleaning machine shown in U.S. Pat. No. 4,295,622, the strips 24 and 30 of the stiff bristle like piles 14 and 16 provide a scrubbing action of the carpet or rug. The stiffer piles 14 provide for an aggressive scrubbing deep into the carpet or rug whereas the longer softer piles 16 provide for a less aggressive scrubbing action closer to the surface of the carpet or rug. The stiffer piles 14 have a shorter pile length than the softer piles 16 so that they are not so aggressive that they will damage the carpet or rug. The strips 24 and 30 being angled with respect to the radius rather than being radial, provide a longer edge for cleaning the carpet. However, the most aggressive scrubbing is achieved at the apex of each of the V's where a strip 24 meets with a strip 30. At the apex of each of the V's, the aggressive scrubbing results in a build up of dirt from the carpet or rug. The looped piles 18 provide a dense surface to perform a cleaning action as well as to pick up and retain the dirty cleaning solution.

It is most desirable to have an even number of V's on each base sheet 12 with the V's being diametrically opposed to each other for symmetry and to achieve a balanced rotation of the cleaning pad 10. Although more than two V's may be provided on each base sheet 12, it has been found that two V's are preferable in that they provide good cleaning action without being so aggressive that they damage the carpet or rug. Also, the V's on one base sheet 12 are spaced circumferentially from those on the other base sheet 12 for symmetry and a balanced rotation of the cleaning pad 10.

Figure 4:
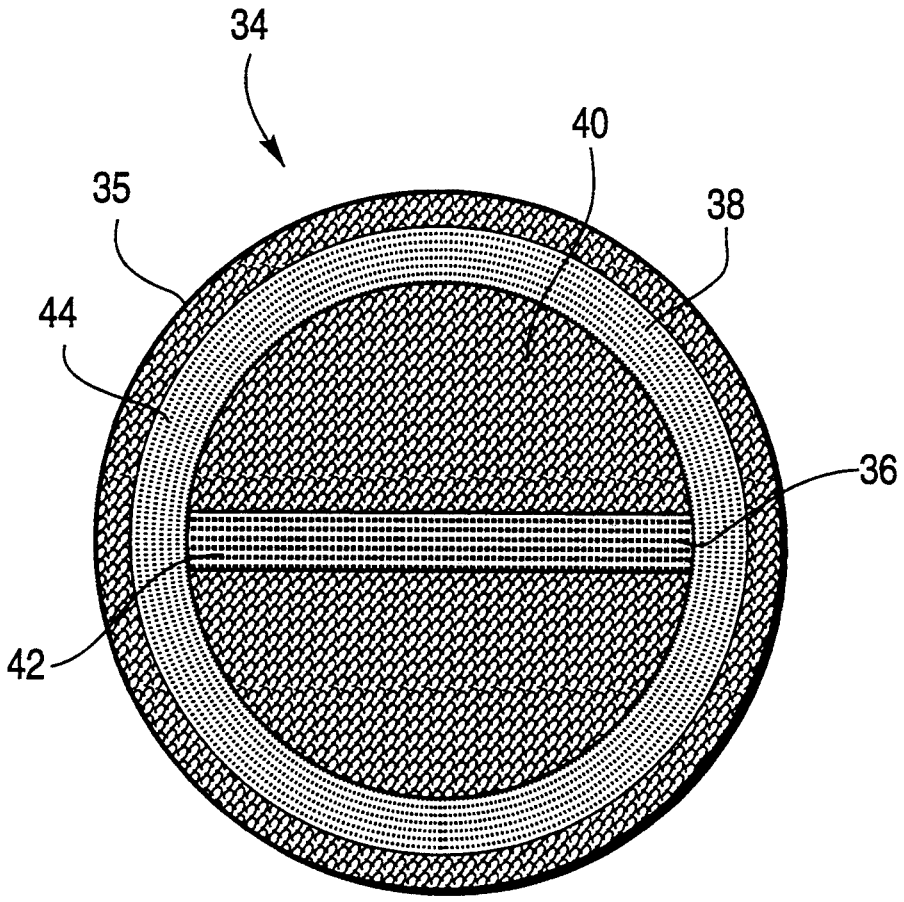
FIG. 4 is a top plan view of another form of the cleaning pad of the present invention.

Referring now to FIG. 4, another form of a cleaning pad of the present invention is generally designated as 34. The cleaning pad 34 is for hand cleaning, such as spots on carpet or rugs or for furniture. The cleaning pad 34, like the cleaning pad 10, is circular in shape but much smaller in size than the cleaning pad 10. The cleaning pad 34 is formed of a pair of circular base sheets 35 of a strong non-woven material which are secured together at their peripheries. However, the base sheets 35 are secured together only around a portion of their peripheries leaving an opening through which a user can place his/her hand within the cleaning pad 34.

Each of the base sheets 35 has thereon three sets of different types of piles 36, 38 and 40. The first set of piles 36 is made up of bristles or relatively stiff fibers which are more or less like those in a hair brush, such as nylon fibers. The second set of piles 38 is made up of bristles which are less stiff than those of the first set of piles 36. A suitable material for the bristles of the second set of piles is olefin. The third set of piles 40 are of strands of strong tough synthetic materials which will withstand the wear and tear of rubbing on the surface to be cleaned and which are absorbent.

The bristles of the first set of piles 36, like the bristles of the first set of piles 14 of the cleaning pad 10 shown in FIGS. 1, 2 and 3, are formed U-shaped pieces of the stiff fibers tufted through the base sheet 35 so that the bases of the U-shaped pieces are all on the inner side of the base sheet 35 and the free ends are all on the outer side of the base sheet 35. The piles 36 are arranged in a row to form an elongated strip 42 which extends diagonally across the base sheet 35. The bristles of the second set of piles 38 likewise are formed U-shaped pieces of the less stiff fibers tufted through the base sheet 35 so that the bases of the U-shaped pieces are all on the inner side of the base sheet 35 and the free ends are all on the outer side of the base sheet 35. The piles 38 are arranged in a row to form an elongated strip 44 which extends in a circle around the periphery of the base sheet 35 and across the ends of the strip 42 of the first set of piles 36.

The third set of piles 40 are of the hooked rug type as it is made of flexible strands which are repeatedly hooked into the base sheet 35. The third set of piles 40 have loops which are spaced along the outer surface of the base sheet 35. The third set of piles 40 fills the remaining area of the base sheets 35 between the strips 42 and 44 and around the circular strip 44. The exposed loops of the third set of piles 40 form an extremely dense surface to perform a cleaning action and to retain dirt under the firm surface.

In the use of the cleaning pad 34, a person insets his/her hand between the base sheets 35. After spraying a dirty spot of a carpet, rug or furniture with a suitable cleaning solution, the person rubs the cleaning pad 34 across the dirty spot, preferably in a rotating motion. The strips 42 and 44 of the relatively stiff bristles scrub into the carpet, rug or furniture to remove the dirt. The looped piles 40 provide a dense surface to perform a cleaning action as well as to pick up and retain dirty cleaning solution.

Thus, there is provided by the present invention a cleaning pad for dry cleaning carpets, rugs, furniture and the like. The cleaning pad has two strips of different stiffness to achieve different levels of aggressive scrubbing so as to fully remove the dirt but without damaging the carpet, rug or furniture. The cleaning pad is formed of two base sheets secured together at their peripheries and the three piles on each of the base sheets. This protects the loops of the piles to prevent them from being pulled from the base sheets and provides the pad with two separate cleaning surfaces. Thus, when one side of the pad becomes dirty, it is only necessary to turn the pad over to continue cleaning with the pad. However, when both sides of the pad become dirty, the pads are washable to remove the dirt and allow the pads to be used again.

What is claimed is:

1. A cleaning pad comprising:

a base sheet of a non-woven material;

first and second strips of fibrous bristles in said base sheet defining a space therebetween, the fibrous bristles of the first strip being stiffer than the fibrous bristles of the second strip; and a bed of firmly looped strands woven to a hooked rug solidity to the base sheet to present a cleaning surface filling the space of the base sheet between the first and second strips.

2. The cleaning pad of claim 1 wherein the first and second strips are arranged to form a V with each other with the apex of the V being adjacent the periphery of the base sheet and the strips extending across the base sheet.

3. The cleaning pad of claim 2 wherein each of the fibrous bristles is a loop tufted into the base sheet with the bottom of the loop being on one side of the base sheet and the free ends of the loop being on the other side of the base sheet,

4. The cleaning pad of claim 3 in which the fibrous bristles of the first strip have a shorter pile length than the fibrous bristles of the second strip.

5. The cleaning pad of claim 1 wherein there are two of the first strips and two of said second strips in said base sheet with each of the strips extending across the base sheet.

6. The cleaning pad of claim 5 in which each of the first strips forms a V with a separate one of the second strips with the apices of the V's being adjacent the periphery of the base sheet.

7. The cleaning pad of claim 6 in which the apices of the two V's are arranged diagonally opposite each other.

8. The cleaning pad of claim 7 in which each of the fibrous bristles of the first and second strips is a loop tufted into the base sheet with the bottom of the loop being on one side of the base sheet and the free ends of the loop being on the other side of the base sheet.

9. The cleaning pad of claim 8 in which each of the fibrous bristles of the first strips has a pile height shorter than the pile height of the fibrous bristles of the second strips.

10. A cleaning pad comprising:

a pair of circular base sheets of a non-woven material secured together at their peripheries;

first and second strips of fibrous bristles in each of said base sheets defining on the respective base sheet a space therebetween, the fibrous bristles of the first strips being stiffer than the fibrous bristles of the second strips; and a bed of firmly looped strands woven to a hooked rug solidity to the base sheets to present a carpet cleaning surface filling in the space of each base sheet between the strips.

11. The cleaning pad of claim 10 wherein the first and second strips on each base sheet are arranged to form a V with each other with the apex of each of the V's being adjacent the periphery of the respective base sheet and the strips extending across the respective base sheet.

12. The cleaning pad of claim 11 wherein each of the fibrous bristles of each of the strips is a loop tufted into the respective base sheet with the bottom of the loop being on the inner side of the respective base sheet facing the other base sheet and the free ends of the loop being on the outer side of the respective base sheet, and the fibrous bristles of the first strips have a shorter pile height than the fibrous bristles of the second strips.

13. The cleaning pad of claim 10 in which there are two of the first strips and two of the second strips on each of the base sheets with each of the strips extending across its respective base sheet.

14. The cleaning pad of claim 13 in which each of the first strips forms a V with a separate one of the second strips with the apices of the V's being adjacent the periphery of the base sheets.

15. The cleaning pad of claim 14 in which the apices of the V's on each of the base sheets are diagonally opposite each other.

16. The cleaning pad of claim 15 in which the apices of the V's on one of the base sheets are circumferentially spaced 90° from the apices of the V's on the other base sheet.

17. The cleaning pad of claim 16 in which each of the fibrous bristles of each of the strips is a loop tufted into the respective base sheet with the bottom of the loop being on one side of the respective base sheet and the free ends of the loop being on the other side of the respective base sheet, and each of the fibrous bristles of each of the first strips has a pile height shorter than the pile height of the fibrous bristles of each of the second strips.

* * * * *